US005211574A

United States Patent [19]

Van Wyk

[11] Patent Number: 5,211,574

[45] Date of Patent: May 18, 1993

[54] HIGH DENSITY ELECTRICAL CONNECTOR ASSEMBLY WITH IMPROVED ALIGNMENT/GUIDE MEANS

[75] Inventor: Fred Van Wyk, Yorba Linda, Calif.

[73] Assignee: Molex Incorporated, Lisle, Ill.

[21] Appl. No.: 850,602

[22] Filed: Mar. 13, 1992

[51] Int. Cl.[5] ..... H01R 13/64

[52] U.S. Cl. ..... 439/378; 439/680

[58] Field of Search ..... 439/312, 378, 680

[56] References Cited

U.S. PATENT DOCUMENTS

| | | | |
|---|---|---|---|
| 2,935,724 | 5/1960 | Seifried et al. | 439/378 |
| 3,271,727 | 9/1966 | Nelson | 439/680 X |
| 3,287,031 | 11/1966 | Simons et al. . | |
| 3,497,866 | 2/1970 | Patton | 439/680 |
| 4,321,121 | 3/1982 | Riches et al. | 439/312 |
| 4,647,130 | 3/1987 | Blair et al. | 339/64 M |
| 4,741,708 | 5/1988 | Yoshida | 438/483 |
| 4,802,861 | 2/1989 | Gaston | 439/376 |
| 4,820,180 | 4/1989 | Mosquera et al. | 439/248 |

FOREIGN PATENT DOCUMENTS

| | | | |
|---|---|---|---|
| 357808 | 7/1938 | Italy | 439/378 |

*Primary Examiner*—Eugene F. Desmond
*Attorney, Agent, or Firm*—A. A. Tirva

[57] ABSTRACT

A high density electrical connector assembly is disclosed and includes a male plug connector having a protruding insulating housing portion with a plurality of passageways therethrough. A plurality of pin contacts are mounted in the passageways. A female receptacle connector has a recessed insulating housing portion for receiving the protruding insulating housing portion of the male plug connector. A plurality of socket contacts are mounted in the recessed insulating housing portion and project from a mating face thereof for receiving the pin contacts. Complementary interengaging keys and keyways are provided between the housing portions of the connectors to properly align the connectors in initial mating engagement. A plurality of guide pins project from one of the insulating housing portions, and a plurality of corresponding guide holes are provided in the other of the insulating housing portions to finely position the pin and socket contacts to attain mating alignment thereof.

6 Claims, 2 Drawing Sheets

HIGH DENSITY ELECTRICAL CONNECTOR ASSEMBLY WITH IMPROVED ALIGNMENT/GUIDE MEANS

FIELD OF THE INVENTION

This invention generally relates to the art of electrical connectors and, particularly, to a high density electrical connector assembly which includes initial guide means for a pair of mating electrical connectors and fine alignment means to insure proper positioning of pin and socket contacts of the connectors.

BACKGROUND OF THE INVENTION

High density electrical connectors are used in a wide variety of applications, including industrial-type electrical connectors. High density connectors are desirable because they reduce connector sizes, thereby requiring less overall space and eliminating excess bulk. This is highly advantageous in many applications, such as aircraft and aerospace applications, where space and weight savings are at a premium. A typical type of electrical connector assembly of the character described is a circular connector assembly which includes a male plug connector and a female receptacle connector. A coupling ring is rotatably mounted about one of the connectors for rotatably coupling the connectors in mating interengagement. The coupling system may utilize, for example, bayonet type or screw-thread type shells. Small high density pin and socket contacts interconnect when the plug and receptacle connectors are rotatably mated.

As the density of electrical connectors used in such applications increases, problems arise upon mating of the connectors due to misalignment and resulting damage to the exposed pin and socket contacts. It generally is known in the art that cylindrical connectors may be keyed to properly position the connector housings prior to mating. This technology is used in industry standards such as military specification MIL-C-38999. However, this type of guide means between the connector housings, alone, is not sufficiently precise to accurately align the increasingly dense array of pin and socket contacts where tight tolerances are required. Such high density connectors also cause problems due to the high insertion forces required to mate the high number of contacts, especially in environments where the connectors are not easily accessed or for instance, in a blind mating condition or where the connectors must be cycled repeatedly. Therefore, there is a need for improved, precise or fine alignment of such connectors during mating, without increasing the mating insertion forces.

This invention is directed to satisfying such a need and solving the problems outlined above.

SUMMARY OF THE INVENTION

An object, therefore, of the invention is to provide a new and improved alignment/guide means for high density electrical connectors of the character described.

The exemplary embodiment of the invention is disclosed for use in a high density electrical connector assembly which includes a male plug connector having a protruding insulating housing portion, with a plurality of passages therethrough. A plurality of pin contacts are mounted in the passages. A female receptacle connector has a recessed insulating housing portion for receiving the protruding insulating housing portion of the male plug connector. A plurality of socket contacts are mounted in the recessed insulating housing and project from a mating face thereof for receiving the pin contacts. The invention contemplates the combination of complementary interengaging guide means between the housing portions of the connectors to properly align the connectors in initial mating engagement. Fine alignment means project between the housing portions of the connectors to finely position the pin and socket contacts to attain proper mating alignment. The fine alignment means are configured for interengagement after interengagement of the guide means and before interengagement of the pin and socket contacts.

In the preferred embodiment of the invention, the fine alignment means include at least one guide pin projecting from one of the insulating housing portions and a guide hole in the other of the insulating housing portions. As disclosed, the guide pin projects from the mating face of the recessed insulating housing portion of the female receptacle connector, and the guide hole is in the protruding insulating housing portion of the male plug connector.

A feature of the invention is to provide a wear-resistent bushing which lines the guide hole, the bushing being of metal material to receive a metal guide pin. This reduces the wear about the guide hole in applications of repeated coupling and uncoupling of the connectors.

The invention is readily applicable for circular-type connectors which include a rotary coupling ring rotatably mounted on one of the connectors and rotatably engageable with the other connector for drawing the connectors into mating engagement. The complementary interengaging guide means between the housing portions of the connectors may be provided in the form of a key on one of the housing portions and a keyway in the other of the housing portions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
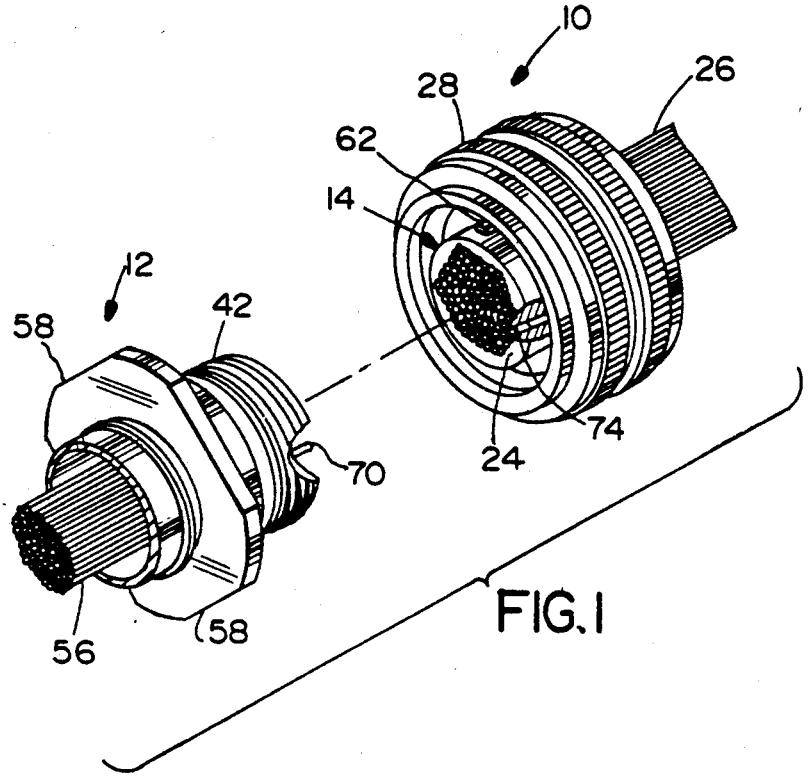
FIG. 1 is a perspective view of a connector assembly embodying the concepts of the invention consisting of a female receptacle connector and a male plug connector.
Figure 3:
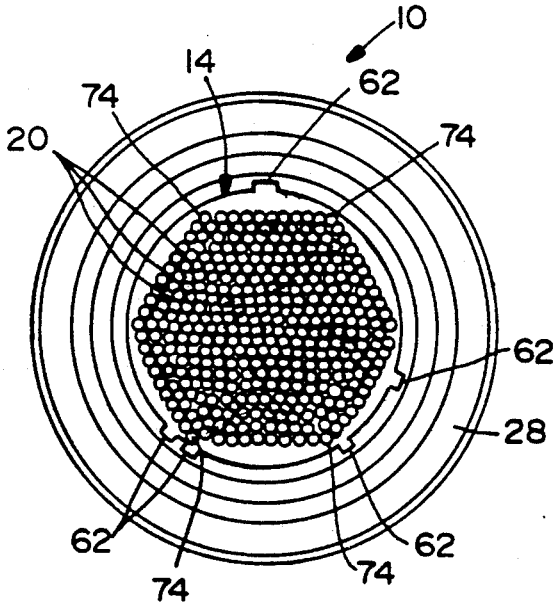
FIG. 3 is an end elevational view looking toward the left-hand end of FIG. 2.
Figure 2:
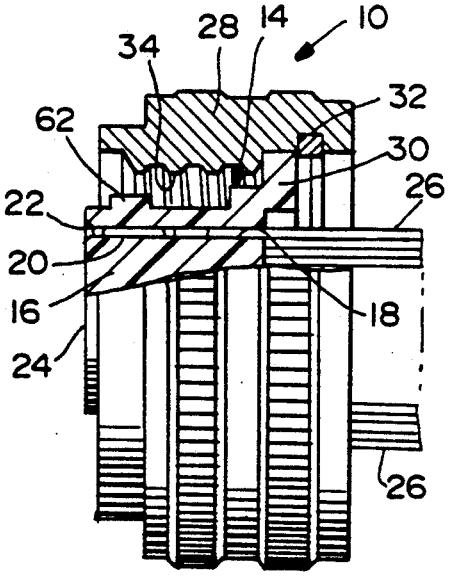
FIG. 2 is a fragmented side elevational view of a male plug connector embodying the concepts of the invention.
Figure 4:
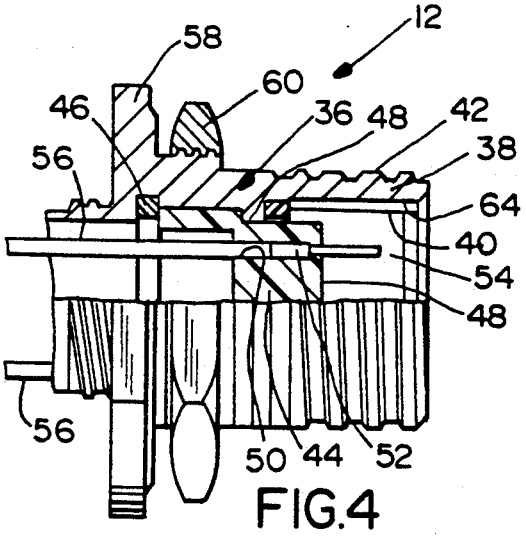
FIG. 4 is a fragmented side elevational view of a female receptacle connector embodying the concepts of the invention.

Referring to the drawings in greater detail, FIGS. 1 and 2 show a male plug connector, generally designated 10, and FIGS. 3 and 4 show a female receptacle connector, generally designated 12. The connectors are mateable in a high density electrical connector assembly in which the invention is applicable.

More particularly, male plug connector 10 (FIGS. 1 and 2) includes a dielectric housing, generally designated 14, which has a protruding housing portion 16. The housing is unitarily molded of insulating plastic material or the like. The protruding housing portion 16 defines a plug of the connector and includes a plurality of through passageways 18 for receiving and mounting respective pin contacts 20 therein. The passageways have open mating ends 22 in a mating face 24 of the protruding housing portion. The pin contacts are terminated to a plurality of insulated electrical wires 26 (FIG. 1). Although only one passageway 18 and pin contact 20 are shown in FIG. 1 in order to facilitate the illustration, it can be seen in FIG. 2 that plug connector 10 is a very high density electrical connector. As shown, the connector mounts in excess of 400 pin contacts 20 per square inch in a close hexagonal array.

Plug connector 10 and receptacle connector 12 are circular connectors designed for mating interengagement and are mechanically and electrically coupled by a coupling ring 28 (FIG. 1) rotatably mounted on housing 14 by means of a radially outwardly projecting peripherally flanged portion 30 of the housing engaged by a locking ring 32 inside coupling ring 28. Therefore, the coupling ring is rotatable about the housing. The coupling ring has internal threads 34.

Up to this point, the above description of male plug connector 10 is generally conventional for an industrial, circular, high density plug connector.

Female receptacle connector 12 includes a shell, generally designated 36, unitarily formed of conductive metallic material or the like. The shell includes a recessed portion 38 defining a cylindrical recess 40 for receiving protruding insulating housing portion or plug 16 of plug connector 10. The outside of shell 36 is externally threaded, as at 42, for threading engagement with internal threads 34 of coupling ring 28 of plug connector 10, whereby the plug and receptacle connectors are mated by inserting plug portion 16 of the plug connector into recess 40 of the receptacle connector and rotating coupling ring 28 to draw the connectors into mating condition.

A dielectric insulating insert 44, unitarily molded of plastic material or the like, is disposed within housing 36 of receptacle connector 12 and is held therewithin by a lock ring 46 and interengaging shoulder means 48 between the insert and the shell. The insert defines a mating face 48 within recess 40 and is provided with a plurality of through passages 50 for receiving and mounting a plurality of socket contacts 52 having socket portions 54 projecting into recess 40 from mating face 48. The socket contacts are terminated to a plurality of insulated electrical wires 56.

Like plug connector 10, and referring to FIG. 4, receptacle connector 12 mounts a high number of socket contacts 52, with socket portions 54 thereof being visible in FIG. 4. Again, there may be in excess of 400 socket contacts per square inch in a hexagonal array for mating with pin contacts 20 of plug connector 10.

Again, up to this point, the above description of receptacle connector 10 is generally conventional for a high density, circular industrial connector. In fact, it can be seen that shell 36 of receptacle connector 12 has an enlarged, radially projecting peripheral flange 58 and a nut 60 threaded onto the outside of the housing for panel-mounting the receptacle connector in a hole in an appropriate panel, with the panel sandwiched between flange 58 and nut 60.

Generally, the invention is directed to the combination of complementary interengaging guide means between housing portions 16 of plug connector 10 and shell portion 38 of receptacle connector 12 to properly align the connectors in initial mating engagement, along with fine alignment means projecting between the housing portions to finely position pin and socket contacts 20 and 52, respectively, to attain mating alignment. Preferably, the fine alignment means are configured for interengagement after interengagement of the guide means and before interengagement of the pin and socket contacts.

More particularly, the complementary interengaging guide means between housing portions 16 and shell portion 38 are provided in the form of a plurality of keys 62 integral with and projecting radially outwardly of plug portion 16 of housing 28 of plug connector 10. A plurality of keyways 64 are formed on the inside of recessed portion 38 of shell 36 of receptacle connector 12. It can be seen in FIGS. 2 and 4 that keys 62 and keyways 64 are irregularly spaced angularly about the array of pin and socket contacts, but the keys and keyways are matched in spacing to insure proper engagement of the pin contacts with predetermined ones of the socket contacts.

Upon coupling plug and receptacle connectors 10 and 12, respectively, by means of coupling ring 28 as described above, keys 62 will enter keyways 64 to properly align the connectors in initial mating engagement.

Figure 5:
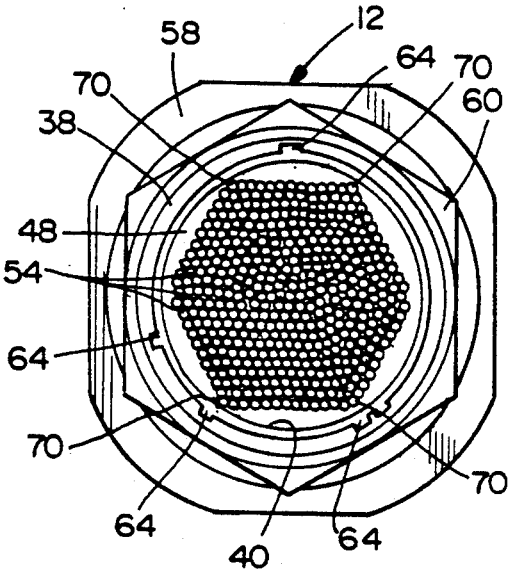
FIG. 5 is an end elevational view looking toward the right-hand end of FIG. 4.
Figure 6:
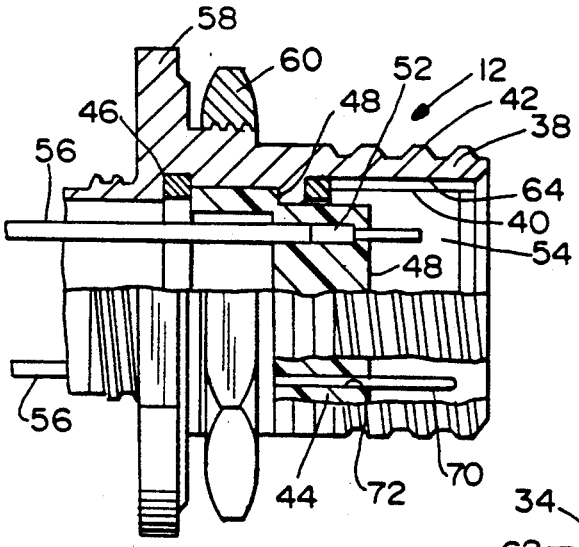
FIG. 6 is a view similar to that of FIG. 4, further broken away to illustrate one of the guide pins.
Figure 7:
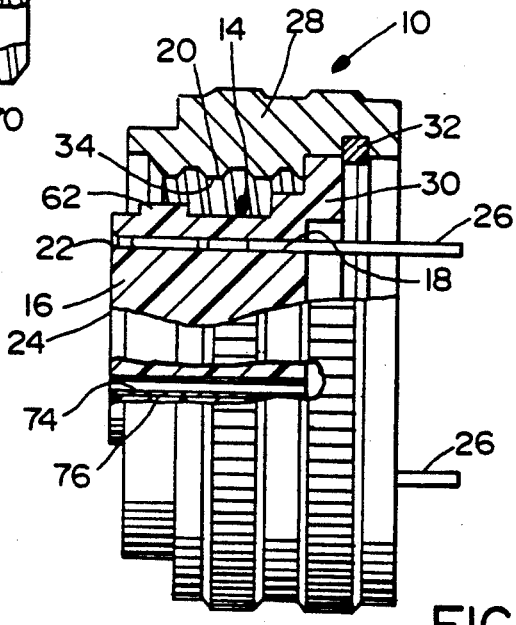
FIG. 7 is a view similar to that of FIG. 2, further broken away to illustrate one of the guide holes.

The fine alignment means, referring to FIGS. 5 and 6, are provided in the form of a plurality of guide pins 70 fixed within holes 72 in insert 44 (i.e. the housing means) of receptacle connector 12. The guide pins project into recess 40 from mating face 48. A plurality of guide holes 74 are formed in plug housing portion 16 of plug connector 10 for receiving guide pins 70 of the receptacle connector. Although only one guide pin 70 and one guide hole 74 are shown in FIGS. 5 and 6, respectively, preferably a plurality of such interengaging guide pins and guide holes are provided. For instance, referring back to FIGS. 2 and 4, it can be seen that four guide pins 70 are intermingled among socket portions 54 of socket contacts 52. As shown, the guide pins are located near the periphery of the hexagonal array of the socket contacts. Correspondingly, there are four guide holes 74 at correspondingly located positions in relation to pin contacts 20 of plug connector 10 in FIG. 2.

Referring back to FIG. 5, it can be seen that guide pins 70 are longer than socket portions 54 of socket contacts 52, but the guide pins stop short of the ends of keyways 64. Consequently, the fine alignment means provided by the guide pins (and guide holes 74) interengage after interengagement of the guide means provided by keys 62 and keyways 64, but before interengagement of pin contacts 20 and socket contacts 52 (54).

At least, the guide pins should interengage within the guide holes before the pin and socket contacts engage to ensure proper and fine positioning of the pin and socket contacts to attain mating alignment thereof, which otherwise could not be accomplished by the more "coarse" alignment provided by keys 62 and keyways 64.

Lastly, a feature of the invention is shown in FIG. 6, wherein guide holes 74 are lined by wear-resistent bushings 76. In some applications where the connectors are subjected to repeated mating and unmating, particularly with housing 14 of plug connector 10 being fabricated of dielectric material such as plastic or the like, there would be a tendency for guide pins 70 to wear and enlarge the guide holes, particularly if the guide pins are fabricated of metal material. Obviously, wearing and consequent enlargement of the guide holes will detract from the fine alignment of the pin and socket contacts. By lining the guide holes with wear-resistent bushings, such as metal or the like, this wear is obviated, which is quite useful in applications of repeated mating and unmating of the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector assembly for connecting a first set of insulated wires to a second set of insulated wires, said connector assembly including:

a cylindrical male plug connector having a mating face and including a protruding insulating plug housing with a plurality of passageways formed therein, a plurality of pin contacts mounted in the passageways extending generally parallel to the plug connector axis toward the plug mating face, a key proximate the plug mating face integrally formed with and projecting radially outwardly from the protruding insulating plug housing, and a coupling ring rotatably mounted on the protruding insulating plug housing; and a cylindrical female receptacle connector having a mating face and including a recessed shell for receiving the protruding insulating plug housing and for mechanically and electrically engaging the coupling ring, a keyway formed on an inside surface of the recessed shell adjacent the receptacle mating face adapted to interengage the integrally formed key of the protruding insulating plug housing, an insulating receptacle housing disposed within the shell, and a plurality of socket contacts mounted in the insulating receptacle housing extending generally parallel to the receptacle connector axis toward the receptacle mating face adapted to interengage the pin contacts, whereby the key and keyway insure proper initial alignment of the male plug connector with respect to the female receptacle connector;

wherein the improvement comprises:

a guide pin mounted in the insulating receptacle housing extending generally parallel to the socket contacts past the receptacle mating face;

a guide hole formed in the protruding plug housing portion of the plug connector adapted to receive the guide pin;

the pin contacts of the plug connector are recessed from the plug mating face to protect the pin contacts from damage upon mating; and the socket contacts of the receptacle connector extend past the receptacle mating face, wherein the guide pin extends past the mating face of the receptacle connector a distance further than the socket contacts, whereby the guide pin and guide hole are configured for interengagement after interengagement of said key and keyway and before interengagement of the pin and socket contacts.

2. An electrical connector assembly as set forth in claim 1, wherein the male plug connector mounts in excess of 400 pin contacts per square inch.

3. An electrical connector assembly as set forth in claim 2, wherein the pin contacts are mounted in the protruding plug housing in a close hexagonal array.

4. An electrical connector assembly as set forth in claim 3, wherein the guide hole is located proximate the periphery of the hexagonal array of the pin contacts.

5. An electrical connector assembly as set forth in claim 4, wherein the guide hole is lined with a wear-resistant bushing.

6. An electrical connector assembly as set forth in claim 1, wherein the guide pin has a diameter substantially equal to or less than the diameter of the socket contacts.

* * * * *